US010829344B2

(12) United States Patent
Koushik et al.

(10) Patent No.: US 10,829,344 B2
(45) Date of Patent: Nov. 10, 2020

(54) ELEVATOR SENSOR SYSTEM CALIBRATION

(71) Applicant: Otis Elevator Company, Farmington, CT (US)

(72) Inventors: Sudarshan N. Koushik, West Hartford, CT (US); Paul R. Braunwart, Hebron, CT (US); Soumalya Sarkar, Manchester, CT (US); Teems E. Lovett, Glastonbury, CT (US); George S. Ekladious, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 592 days.

(21) Appl. No.: 15/642,465

(22) Filed: Jul. 6, 2017

(65) Prior Publication Data

US 2019/0010020 A1 Jan. 10, 2019

(51) Int. Cl.
*B66B 5/00* (2006.01)

(52) U.S. Cl.
CPC ..... *B66B 5/0025* (2013.01); *B66B 5/0037* (2013.01)

(58) Field of Classification Search
CPC ..... B66B 5/0025; B66B 5/0037
See application file for complete search history.

(56) References Cited

U.S. PATENT DOCUMENTS 4,649,515 A 3/1987 Thompson et al.
5,557,546 A 9/1996 Fukai et al.
5,597,988 A * 1/1997 Skalski ..... B66B 7/042 187/292
5,760,350 A 6/1998 Pepin et al.
5,774,633 A 6/1998 Baba et al.
5,787,020 A 7/1998 Molliere et al.
6,330,935 B1 12/2001 Systermans
6,330,936 B1 12/2001 Lence Barreiro et al.
6,392,537 B1 5/2002 Tazumi et al.
6,439,350 B1 8/2002 Barreiro et al.
(Continued)

FOREIGN PATENT DOCUMENTS

CN 100546896 10/2009
CN 2010254464 11/2010
(Continued)

OTHER PUBLICATIONS

Z. Wan, et al., "Diagnosis of Elevator Faults with LS-SVM Based on Optimization by K-CV," Hindawi Publishing Corp., Journal of Electrical and Computer Engineering, vol. 2015, Article ID 935038, 2015, 9 pages.
(Continued)

*Primary Examiner* — Manuel A Rivera Vargas
*Assistant Examiner* — Yaritza H Perez Bermudez
(74) *Attorney, Agent, or Firm* — Cantor Colburn LLP

(57) ABSTRACT

According to an aspect, a method of elevator sensor system calibration includes collecting, by a computing system, a plurality of data from one or more sensors of an elevator sensor system while a calibration device applies a known excitation. The computing system compares an actual response to an expected response to the known excitation using a trained model. The computing system performs analytics model calibration to calibrate the trained model based on one or more response changes between the actual response and the expected response.

18 Claims, 6 Drawing Sheets

(56) References Cited

U.S. PATENT DOCUMENTS 6,453,265 B1 9/2002 Dekhil et al.
6,477,485 B1 11/2002 Radulovic et al.
6,526,368 B1 2/2003 Coste et al.
6,543,583 B1 4/2003 Barreiro et al.
6,604,611 B2 8/2003 Liu et al.
6,854,565 B2 * 2/2005 Perala ..... B66B 5/0006 187/247
6,988,594 B2 1/2006 Deplazes et al.
7,143,007 B2 11/2006 Long et al.
7,280,988 B2 10/2007 Helsper et al.
7,423,398 B2 * 9/2008 Tyni ..... B66B 5/0037 318/432
7,434,666 B2 * 10/2008 Tyni ..... B66B 1/40 187/293
7,503,434 B2 * 3/2009 Grundmann ..... B66B 13/14 187/316
7,546,903 B2 * 6/2009 Kattainen ..... B66B 1/3492 187/316
7,637,355 B2 * 12/2009 Tyni ..... B66B 13/143 187/315
7,650,970 B2 * 1/2010 Lelic ..... B66B 13/22 187/316
7,703,579 B2 * 4/2010 Tyni ..... B66B 5/0025 187/291
7,729,806 B2 * 6/2010 Ohira ..... B66B 1/34 187/247
7,823,706 B2 * 11/2010 Tyni ..... B66B 5/0031 187/391
7,958,970 B2 6/2011 Ma et al.
8,653,982 B2 2/2014 Yulkowski et al.
8,678,143 B2 * 3/2014 Bunter ..... B66B 5/0025 187/393
8,838,417 B2 9/2014 Rikkola et al.
9,033,114 B2 * 5/2015 Mizon ..... B66B 1/00 187/247
9,120,646 B2 * 9/2015 Loeb ..... B66B 13/26
9,309,089 B2 * 4/2016 Annen ..... B66B 5/0025
9,535,808 B2 1/2017 Bates et al.
9,906,112 B2 * 2/2018 Dwari ..... H02J 3/02
2002/0193920 A1 * 12/2002 Miller ..... G05B 23/0245 701/32.9
2003/0217894 A1 11/2003 Perala et al.
2005/0034931 A1 * 2/2005 Deplazes ..... B66B 13/22 187/313
2005/0167204 A1 8/2005 Husmann et al.
2006/0037818 A1 2/2006 Deplazes et al.
2007/0016332 A1 1/2007 Tyni et al.
2008/0230326 A1 * 9/2008 Tyni ..... B66B 5/0031 187/393
2009/0166134 A1 * 7/2009 Jahkonen ..... B66B 1/3492 187/394
2012/0041575 A1 * 2/2012 Maeda ..... G05B 23/024 700/80
2012/0193169 A1 8/2012 Mizon
2014/0337256 A1 11/2014 Varadi et al.
2015/0083528 A1 * 3/2015 Kattainen ..... B66B 5/0031 187/393
2015/0321884 A1 * 11/2015 Kalliomaki ..... B66B 5/28 187/247
2016/0096272 A1 * 4/2016 Smith ..... G06N 3/008 700/253
2016/0109229 A1 4/2016 Yeum
2016/0185569 A1 * 6/2016 Sonnenmoser ..... B66B 5/0025 187/393
2016/0203036 A1 7/2016 Mezic et al.
2016/0330225 A1 11/2016 Kroyzer et al.
2016/0371599 A1 12/2016 Nicholas et al.
2017/0029246 A1 2/2017 Kulak et al.
2017/0235857 A1 8/2017 Haye
2017/0313552 A1 11/2017 Hubbard et al.
2018/0066943 A1 3/2018 Bortolami et al.
2018/0319015 A1 * 11/2018 Sinyavskiy ..... B25J 9/0081
2019/0010019 A1 1/2019 Koushik et al.
2019/0010021 A1 1/2019 Sarkar et al.

FOREIGN PATENT DOCUMENTS

CN 102765642 11/2012
CN 2012240781 12/2012
CN 103678952 3/2014
CN 102482057 12/2014
CN 103303758 1/2016
CN 105731209 7/2016
CN 104291174 9/2016
EP 1556303 6/2006
EP 2562614 2/2013
EP 2813911 6/2013
JP H03106774 5/1991
JP 10265154 10/1998
JP 5189340 4/2013
JP 5544885 7/2014
WO 2005015326 2/2005
WO 2008006116 A2 1/2008

OTHER PUBLICATIONS

EP Application No. 18181963.2 Extended EP Search Report dated Dec. 7, 2018, 7 pages.
EP Application No. 18182303.0 Extended EP Search Report dated Dec. 7, 2018, 6 pages.
EP Application No. 18182305.5 Extended EP Search Report dated Dec. 7, 2018, 6 pages.

* cited by examiner

ELEVATOR SENSOR SYSTEM CALIBRATION

BACKGROUND

The subject matter disclosed herein generally relates to elevator systems and, more particularly, to elevator sensor system calibration.

An elevator system can include various sensors to detect the current state of system components and fault conditions. To perform certain types of fault or degradation detection, precise sensor system calibration may be needed. Sensor systems as manufactured and installed can have some degree of variation. Sensor system responses can vary compared to an ideal system due to these sensor system differences and installation differences, such as elevator component characteristic variations in weight, structural features, and other installation effects.

BRIEF SUMMARY

According to some embodiments, a method of elevator sensor system calibration is provided. The method includes collecting, by a computing system, a plurality of data from one or more sensors of an elevator sensor system while a calibration device applies a known excitation. The computing system compares an actual response to an expected response to the known excitation using a trained model. The computing system performs analytics model calibration to calibrate the trained model based on one or more response changes between the actual response and the expected response.

In addition to one or more of the features described above or below, or as an alternative, further embodiments may include where the trained model is trained by applying the known excitation to a different instance of the elevator sensor system to produce the expected response.

In addition to one or more of the features described above or below, or as an alternative, further embodiments may include where performing analytics model calibration includes applying transfer learning to determine a transfer function based on the one or more response changes across a range of data points produced by the known excitation.

In addition to one or more of the features described above or below, or as an alternative, further embodiments may include where a baseline designation of the trained model is shifted according to the transfer function.

In addition to one or more of the features described above or below, or as an alternative, further embodiments may include where transfer learning shifts at least one fault detection boundary of the trained model.

In addition to one or more of the features described above or below, or as an alternative, further embodiments may include where transfer learning shifts at least one trained regression model.

In addition to one or more of the features described above or below, or as an alternative, further embodiments may include where transfer learning shifts at least one trained fault detection model, and a fault designation includes one or more of: a roller fault, a track fault, a sill fault, a door lock fault, a belt tension fault, a car door fault, and a hall door fault.

In addition to one or more of the features described above or below, or as an alternative, further embodiments may include where one or more variations of the known excitation applied by the calibration device at one or more predetermined locations on an elevator system are collected.

In addition to one or more of the features described above or below, or as an alternative, further embodiments may include where the known excitation includes a predetermined sequence of one or more vibration frequencies applied at one or more predetermined amplitudes.

In addition to one or more of the features described above or below, or as an alternative, further embodiments may include where the data is collected at two or more different landings of an elevator system.

According to some embodiments, an elevator sensor system is provided that includes one or more sensors operable to monitor an elevator system. A computing system of the elevator sensor system includes a memory and a processor that collects a plurality of data from the one or more sensors while a calibration device applies a known excitation, compares an actual response to an expected response to the known excitation using a trained model, and performs analytics model calibration to calibrate the trained model based on one or more response changes between the actual response and the expected response.

Technical effects of embodiments of the present disclosure include elevator sensor system calibration using injection of a known excitation and transfer learning to calibrate a trained model based on response changes between an actual response and an expected response to the known excitation to improve fault detection accuracy.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

A detailed description of one or more embodiments of the disclosed apparatus and method are presented herein by way of exemplification and not limitation with reference to the Figures.

Figure 1:
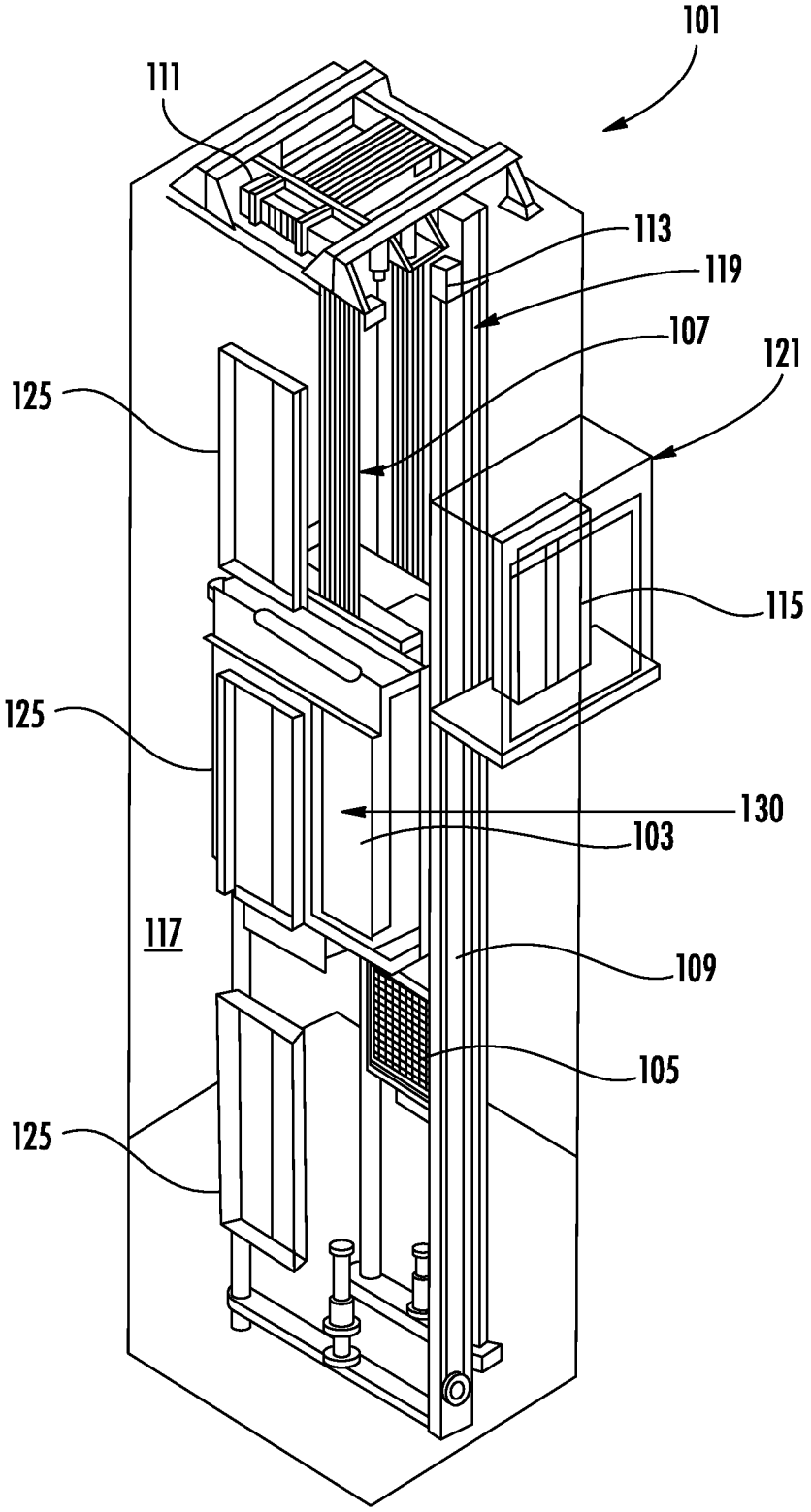
FIG. 1 is a schematic illustration of an elevator system that may employ various embodiments of the present disclosure.

FIG. 1 is a perspective view of an elevator system 101 including an elevator car 103, a counterweight 105, one or more load bearing members 107, a guide rail 109, a machine 111, a position encoder 113, and an elevator controller 115.

The elevator car 103 and counterweight 105 are connected to each other by the load bearing members 107. The load bearing members 107 may be, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The load bearing members 107 engage the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control features within the elevator car 103, including, but not limited to, lighting, display screens, music, spoken audio words, etc.

The machine 111 may include a motor or similar driving mechanism and an optional braking system. In accordance with embodiments of the disclosure, the machine 111 is configured to include an electrically driven motor. The power supply for the motor may be any power source, including a power grid, which, in combination with other components, is supplied to the motor. Although shown and described with a rope-based load bearing system, elevator systems that employ other methods and mechanisms of moving an elevator car within an elevator shaft, such as hydraulics or any other methods, may employ embodiments of the present disclosure. FIG. 1 is merely a non-limiting example presented for illustrative and explanatory purposes.

Figure 2:
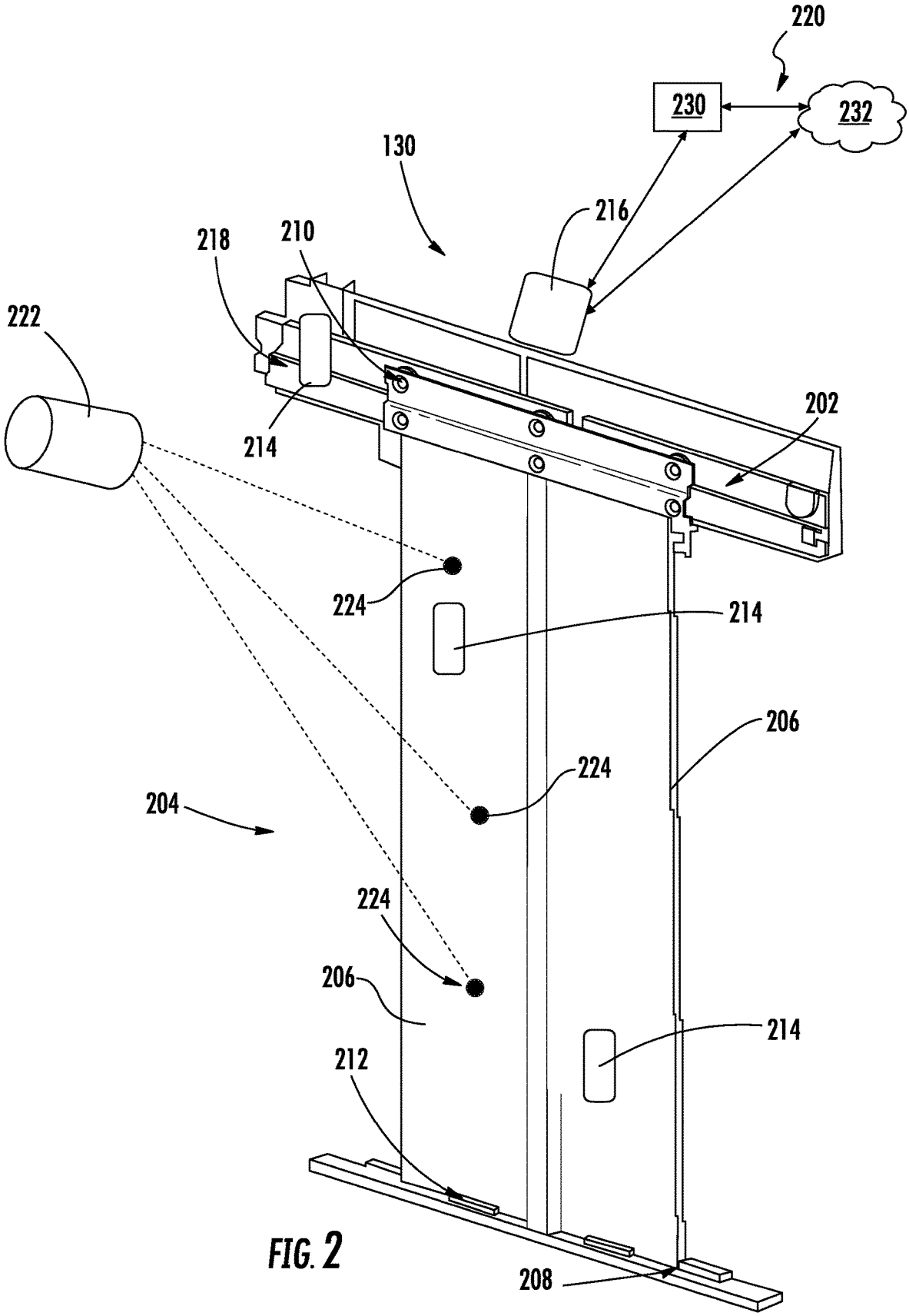
FIG. 2 is a schematic illustration of an elevator door assembly in accordance with an embodiment of the present disclosure.

The elevator car 103 includes at least one elevator door assembly 130 operable to provide access between the each landing 125 and the interior (passenger portion) of the elevator car 103. FIG. 2 depicts the elevator door assembly 130 in greater detail. In the example of FIG. 2, the elevator door assembly 130 includes a door motion guidance track 202 on a header 218, an elevator door 204 including multiple elevator door panels 206 in a center-open configuration, and a sill 208. The elevator door panels 206 are hung on the door motion guidance track 202 by rollers 210 to guide horizontal motion in combination with a gib 212 in the sill 208. Other configurations, such as a side-open door configuration, are contemplated. One or more sensors 214 are incorporated in the elevator door assembly 130 and are operable to monitor the elevator door 204. For example, one or more sensors 214 can be mounted on or within the one or more elevator door panels 206 and/or on the header 218. In some embodiments, motion of the elevator door panels 206 is controlled by an elevator door controller 216, which can be in communication with the elevator controller 115 of FIG. 1. In other embodiments, the functionality of the elevator door controller 216 is incorporated in the elevator controller 115 or elsewhere within the elevator system 101 of FIG. 1. Further, calibration processing as described herein can be performed by any combination of the elevator controller 115, elevator door controller 216, a service tool 230 (e.g., a local processing resource), and/or cloud computing resources 232 (e.g., remote processing resources). The sensors 214 and one or more of: the elevator controller 115, the elevator door controller 216, the service tool 230, and/or the cloud computing resources 232 can be collectively referred to as an elevator sensor system 220.

The sensors 214 can be any type of motion, position, acoustic, or force sensor or acoustic sensor, such as an accelerometer, a velocity sensor, a position sensor, a force sensor, a microphone or other such sensors known in the art. The elevator door controller 216 can collect data from the sensors 214 for control and/or diagnostic/prognostic uses. For example, when embodied as accelerometers, acceleration data (e.g., indicative of vibrations) from the sensors 214 can be analyzed for spectral content indicative of an impact event, component degradation, or a failure condition. Data gathered from different physical locations of the sensors 214 can be used to further isolate a physical location of a degradation condition or fault depending, for example, on the distribution of energy detected by each of the sensors 214. In some embodiments, disturbances associated with the door motion guidance track 202 can be manifested as vibrations on a horizontal axis (e.g., direction of door travel when opening and closing) and/or on a vertical axis (e.g., up and down motion of rollers 210 bouncing on the door motion guidance track 202). Disturbances associated with the sill 208 can be manifested as vibrations on the horizontal axis and/or on a depth axis (e.g., in and out movement between the interior of the elevator car 103 and an adjacent landing 125.

Embodiments are not limited to elevator door systems but can include any elevator sensor system within the elevator system 101 of FIG. 1. For example, sensors 214 can be used in one or more elevator subsystems for monitoring elevator motion, door motion, position referencing, leveling, environmental conditions, and/or other detectable conditions of the elevator system 101.

To support calibration of the elevator sensor system 220, a calibration device 222 can be placed in contact with the elevator door 204 at one or more predetermined locations 224 to apply a known excitation that is detectable by the sensors 214. The calibration device 222 can be configured to inject a predetermined sequence of one or more vibration frequencies applied at one or more predetermined amplitudes to one or more of the predetermined locations 224. For instance, placing the calibration device 222 closer to the door motion guidance track 202 can induce a vibration more similar to a roller fault or a track fault, while placing the calibration device 222 closer to the sill can induce a vibration more similar to a sill fault. The calibration device 222 need not precisely simulate an actual fault, as the actual sensed response to the excitation can be used to calibrate a trained model as further described herein.

Figure 3:
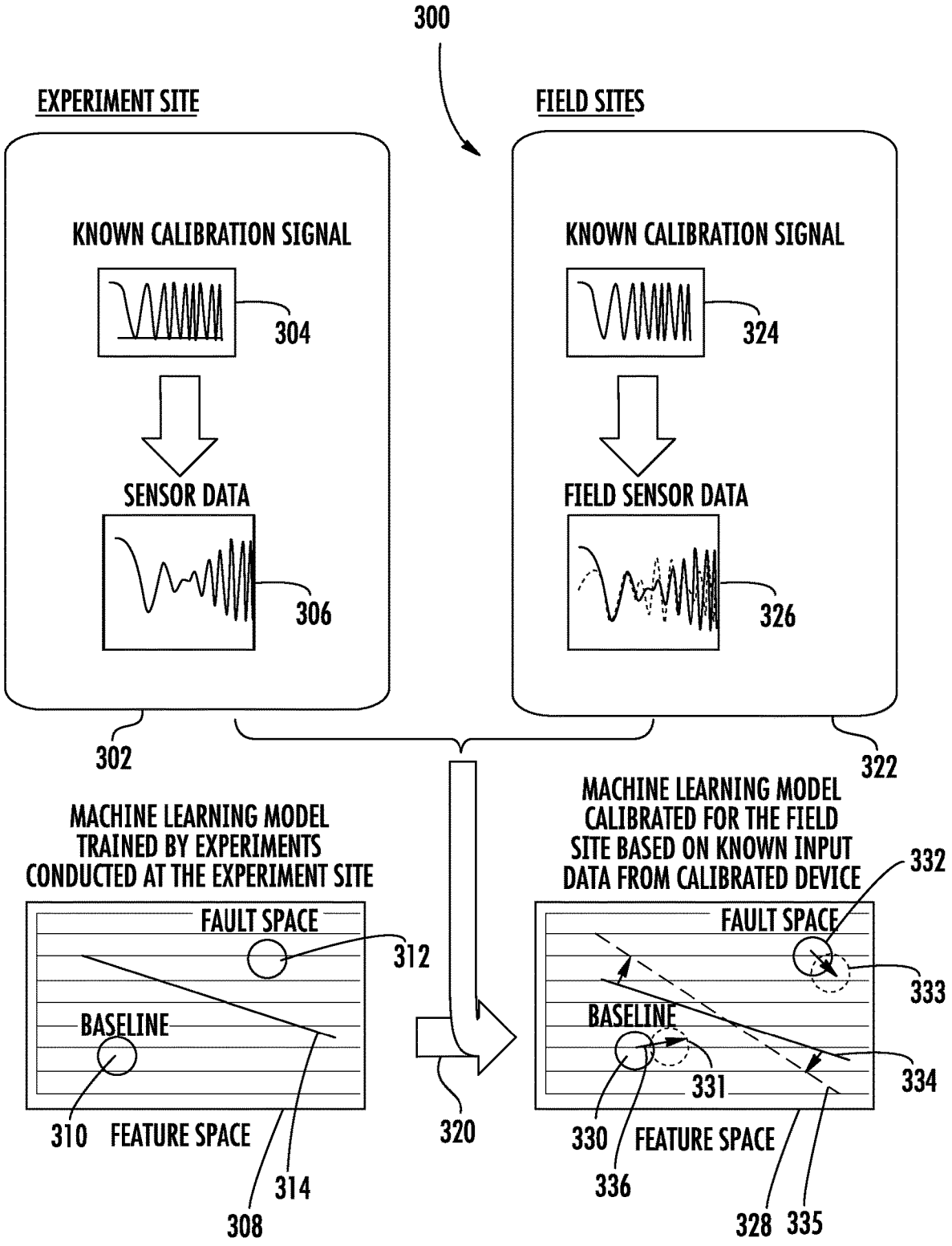
FIG. 3 is a process of transfer learning for calibration in accordance with an embodiment of the present disclosure.

FIG. 3 depicts a transfer learning process 300 according to an embodiment. At an experiment site 302, a known excitation 304 provides a known calibration signal to an instance of the elevator sensor system 220 of FIG. 2. Data 306 is collected by instances of the sensors 214 of FIG. 2 at the experiment site 302 responsive to the known excitation 304. A response to the known excitation 304 for a non-faulty configuration at the experiment site 302 can be determined relative to a feature space 308 of a trained model that establishes a baseline designation 310, a fault designation 312, and one or more fault detection boundaries 314.

Multiple experiments can be run at the experiment site 302 to establish the feature space 308 used to detect and classify various features. For example, the baseline designation 310 in the feature space 308 can establish a nominal expected response to cycling of the elevator door 204 of FIG. 2 in a horizontal motion between an open and closed position and/or between a closed and open position. The baseline designation 310 may represent expected frequency response characteristics of an instance of the elevator door assembly 130 of FIG. 1 at the experiment site 302 for a non-faulty configuration. The one or more fault detection boundaries 314 can be used to establish boundaries or regions within the feature space 308 of a likelihood of a fault/no-fault condition and/or for trending to observe response shifts headed from the baseline designation 310 towards the fault designation 312, e.g., a progressive degraded response. The experiment site 302 can be a test lab or a field location known to have one or more components in a faulty/degraded condition. For instance, the experiment site 302 in a lab or field location can have known correctly working components and known worn/broken components to use for baseline development and model training.

Observations can be made at the experiment site 302 as to the effect of applying the known excitation 304 at one or more predetermined locations 224 of FIG. 2 using one or more vibration profiles, such as a sinusoidal sweep of vibration frequencies at a fixed or varying amplitude while the elevator doors 204 remain in a substantially fixed position (e.g., closed). An expected response to the known excitation 304 can be quantified in the form of resulting offsets in the feature space 308 from the baseline designation 310, fault designation 312, and/or fault detection boundaries 314, for instance, in multiple dimensions.

To calibrate instances of the elevator sensor system 220 of FIG. 2 at one or more field sites 322, a known excitation 324 that is equivalent to the known excitation 304 provides a known calibration signal to the elevator sensor system 220 using the calibration device 222. At each of the field sites 322, data 326 is collected by instances of the sensors 214 of FIG. 2 responsive to the known excitation 324. An expected response from the experiment site 302 is transferred 320 to the field sites 322 for comparison with an actual response to the known excitation 324. Various transfer learning algorithms, such as baseline relative feature extraction, baseline affine mean shifting, similarity-based feature transfer, covariate shifting by kernel mean matching, and/or other transfer learning techniques known in the art, can be used to develop a transfer function 336 with respect to feature spaces 308, 328. The known excitation 324 can provide a range of data points beyond baseline designation 330. For example, the known excitation 304 can expose non-linearity which can be accounted for in the transfer function 336 to improve model accuracy. The feature space 328 at the field sites 322 can initially be equivalent to a copy of the feature space 308 of a trained model that establishes a baseline designation 330 equivalent to baseline designation 310, a fault designation 332 equivalent to fault designation 312, and one or more fault detection boundaries 334 equivalent to fault detection boundaries 314. The transfer function 336 can be generated using transfer learning from baseline data collection (baseline designation 310, 330), sensed calibrated signal data of known excitation 324, and a response collected in data 326. The result of applying transfer function 336 to models in feature space 328 is that the fault data signature 332 and detection boundary 334 are calibrated according to the specific waveform propagation characteristics of the field site 322. The calibrated fault detection boundary 335 and calibrated fault designation 333 (i.e., data signature) represent a calibrated analytics model.

In embodiments, transfer learning can be used for trained model calibration at field sites 322 based on known excitation 324 applied at one or more predetermined locations 224 of FIG. 2 using the calibration device 222 to apply one or more vibration profiles, such as a sinusoidal sweep of vibration frequencies at a fixed or varying amplitude while the elevator doors 204 of FIG. 2 remain in a substantially fixed position (e.g., closed). Differences between the expected response at the experiment site 302 and the actual response at field sites 322 are quantified to produce calibrated feature shifts in feature space 328 as transfer function 336. For example, baseline designation 330 can be shifted to account for response changes as a calibrated baseline designation 331. Similarly, fault designation 332 can be shifted to account for response changes as a calibrated fault designation 333. Further, one or more fault detection boundaries 334 can be shifted to account for response changes as one or more calibrated fault detection boundaries 335. The shifting in feature space 328 can translate into adjustments of various trained models for feature detection, classification, and regression, for example, as further described with respect to FIG. 4.

Figure 4:
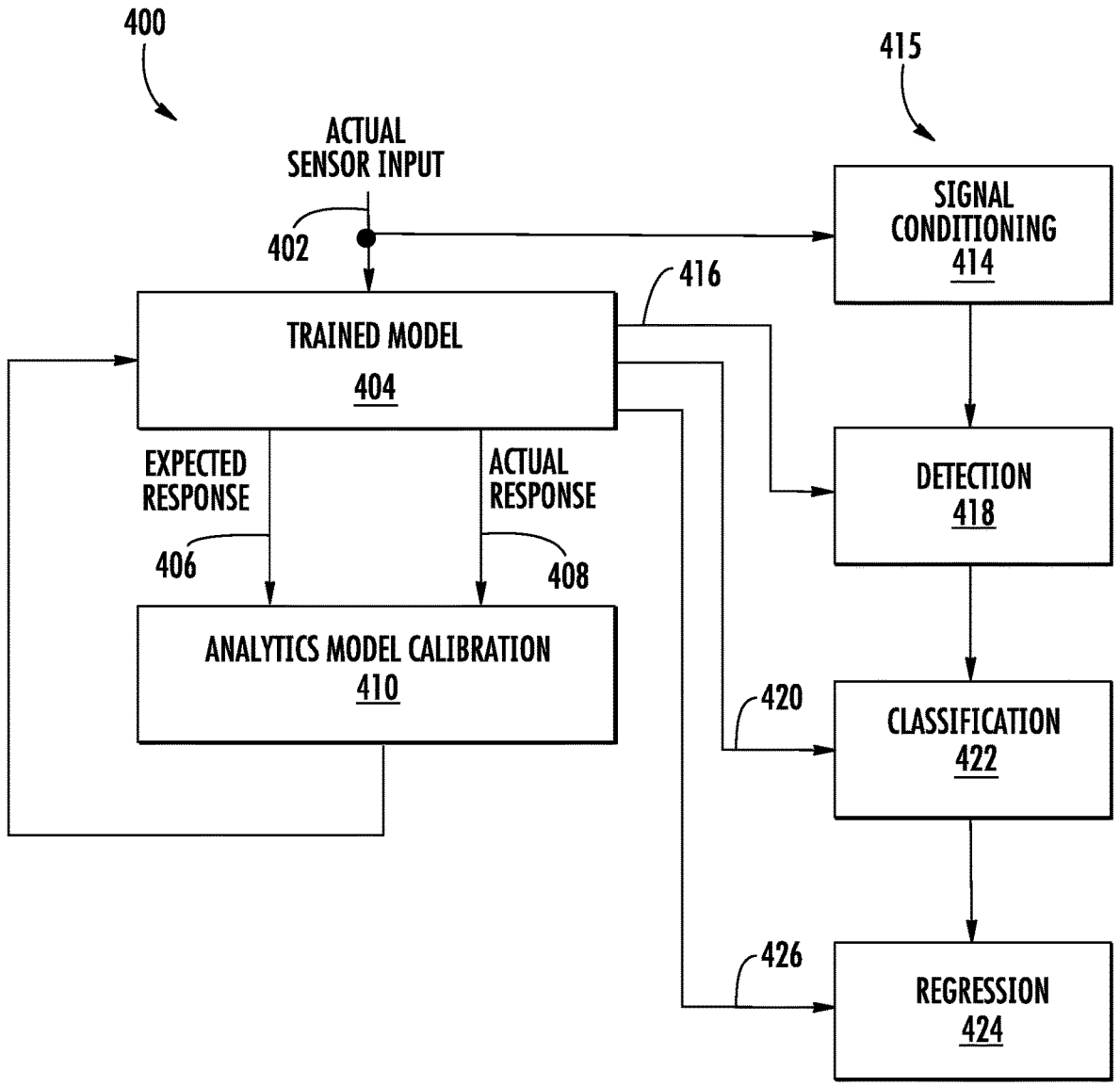
FIG. 4 is a process for analytics model calibration in accordance with an embodiment of the present disclosure.

FIG. 4 depicts an analytics model calibration process 400 according to an embodiment. At one of the field sites 322 of FIG. 3, a computing system of the elevator sensor system 220 of FIG. 2 can receive actual sensor input 402 from one or more sensors 214 of FIG. 2. The actual sensor input 402 in response to the known excitation 324 of FIG. 3 can be provided to a trained model 404 received from the experiment site 302 of FIG. 3. An expected response 406 to the known excitation 324 (e.g., based on previous experiments at the experiment site 302) and an actual response 408 to the known excitation 324 can be analyzed by analytics model calibration 410 to perform transfer learning. The analytics model calibration 410 can apply transfer learning to determine the transfer function 336 of FIG. 3 to calibrate the trained model 404 based on one or more response changes determined between the actual response 408 and the expected response 406. Multiple transfer learning algorithms are contemplated. For example, transfer learning performed by analytics model calibration 410 can apply baseline relative feature extraction, baseline affine mean shifting, similarity-based feature transfer, covariate shifting by kernel mean matching, and/or other transfer learning techniques known in the art. Transfer learning performed in the analytics model calibration 410 can shift a fault designation 332 of the trained model 404 as calibrated fault designation 333, and/or shifts at least one fault detection boundary 334 of the trained model 404 as calibrated fault detection boundary 335 of FIG. 3.

The shifting within trained model 404 based on the transfer function 336 of FIG. 3 can result in changes to feature definitions 416 used by a detection process 418, changes to a trained classification model 420 used by a classification process 422, and/or changes to a trained regression model 426 used by a regression process 424. For example, once calibration of the trained model 404 is performed, the actual sensor input 402 can be provided to signal conditioning 414 as part of a condition determination process 415. The signal conditioning 414 can include filtering, offset corrections, and/or time/frequency domain transforms, such as applying wavelet transforms to produce a spectrum of feature data. The feature definitions 416 (e.g., defined with respect to the feature space 328 of FIG. 3) can be used by the detection process 418 to detect potentially useful features from spectral data of the signal conditioning 414. For instance, the detection process 418 may search for higher energy responses within targeted frequency ranges. The trained classification model 420 can be used by the classification process 422 to classify detected features from the detection process 418, e.g., identifying detected features as fault designations along with specific fault types such as a roller fault, a track fault, a sill fault, and the like. The regression process 424 can use the trained regression model 426 to determine the strength/weakness of various classifications to support trending, prognostics, diagnostics, and the like based on classifications from the classification process 422.

Figure 5:
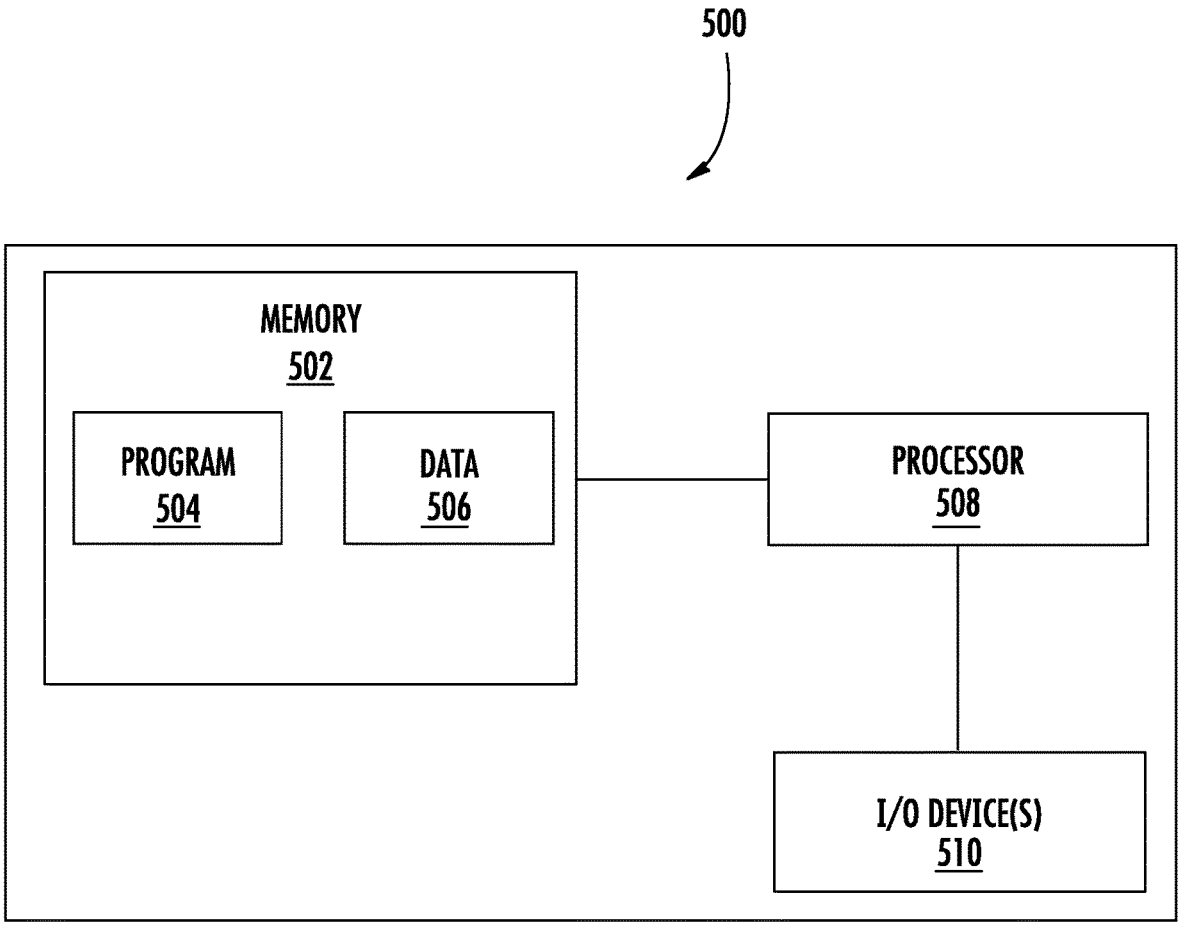
FIG. 5 is a schematic block diagram illustrating a computing system that may be configured for one or more embodiments of the present disclosure.

Referring now to FIG. 5, an exemplary computing system 500 that can be incorporated into elevator systems of the present disclosure is shown. The computing system 500 may be configured as part of and/or in communication with an elevator controller, e.g., controller 115 shown in FIG. 1, and/or as part of the elevator door controller 216, service tool 230, and/or cloud computing resources 232 of FIG. 2 as described herein. When implemented as service tool 230, the computing system 500 can be a mobile device, tablet, laptop computer, or the like. When implemented as cloud computing resources 232, the computing system 500 can be located at or distributed between one or more network-accessible servers. The computing system 500 includes a memory 502 which can store executable instructions and/or data associated with control and/or diagnostic/prognostic systems of the elevator door 204 of FIG. 2. The executable instructions can be stored or organized in any manner and at any level of abstraction, such as in connection with one or more applications, processes, routines, procedures, methods, etc. As an example, at least a portion of the instructions are shown in FIG. 5 as being associated with a control program 504.

Further, as noted, the memory 502 may store data 506. The data 506 may include, but is not limited to, elevator car data, elevator modes of operation, commands, or any other type(s) of data as will be appreciated by those of skill in the art. The instructions stored in the memory 502 may be executed by one or more processors, such as a processor 508. The processor 508 may be operative on the data 506.

The processor 508, as shown, is coupled to one or more input/output (I/O) devices 510. In some embodiments, the I/O device(s) 510 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 510, in some embodiments, include communication components, such as broadband or wireless communication elements.

The components of the computing system 500 may be operably and/or communicably connected by one or more buses. The computing system 500 may further include other features or components as known in the art. For example, the computing system 500 may include one or more transceivers and/or devices configured to transmit and/or receive information or data from sources external to the computing system 500 (e.g., part of the I/O devices 510). For example, in some embodiments, the computing system 500 may be configured to receive information over a network (wired or wireless) or through a cable or wireless connection with one or more devices remote from the computing system 500 (e.g. direct connection to an elevator machine, etc.). The information received over the communication network can stored in the memory 502 (e.g., as data 506) and/or may be processed and/or employed by one or more programs or applications (e.g., program 504) and/or the processor 508.

The computing system 500 is one example of a computing system, controller, and/or control system that is used to execute and/or perform embodiments and/or processes described herein. For example, the computing system 500, when configured as part of an elevator control system, is used to receive commands and/or instructions and is configured to control operation of an elevator car through control of an elevator machine. For example, the computing system 500 can be integrated into or separate from (but in communication therewith) an elevator controller and/or elevator machine and operate as a portion of elevator sensor system 220 of FIG. 2.

Figure 6:
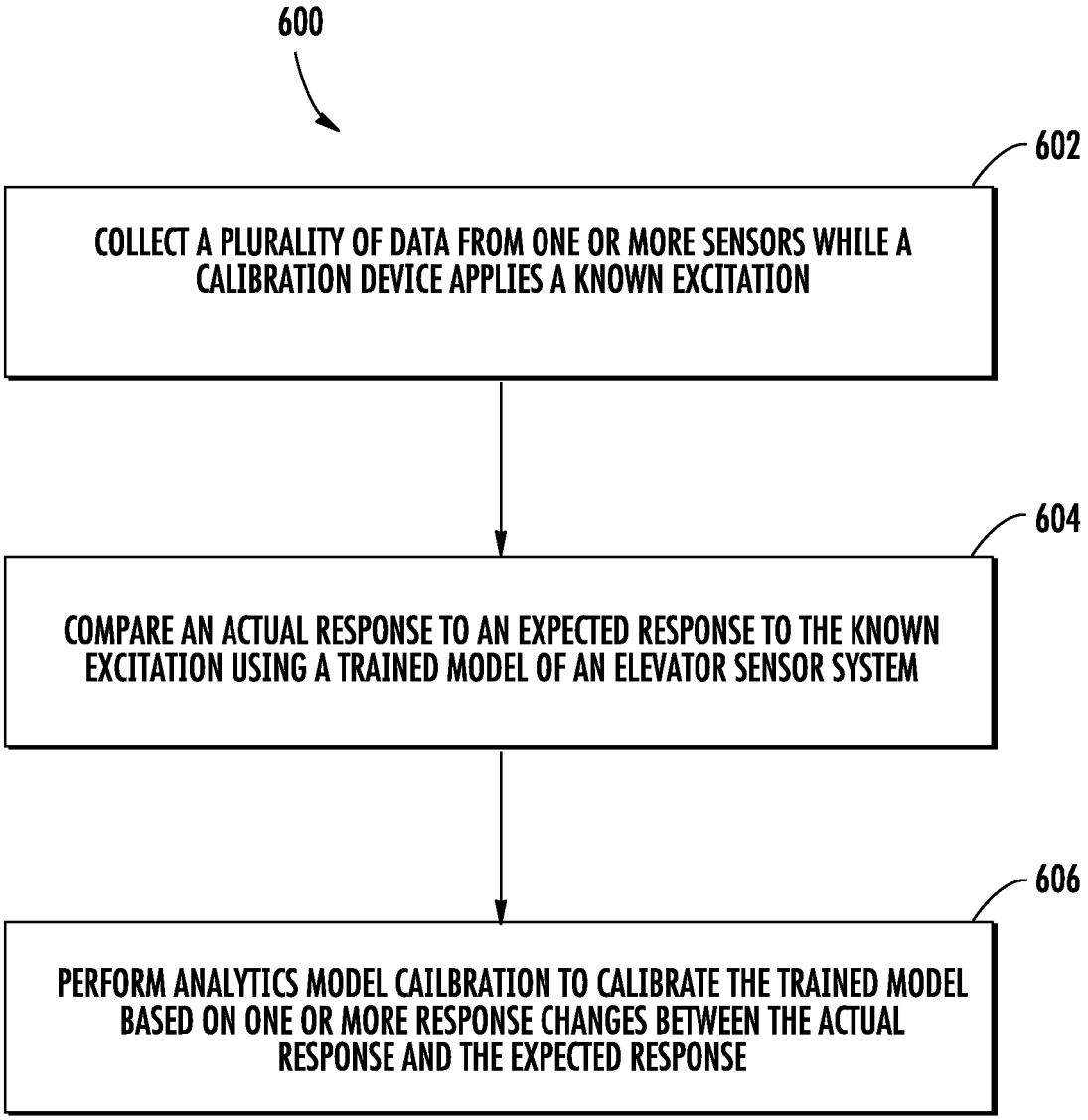
FIG. 6 is a process for elevator door sensor system calibration in accordance with an embodiment of the present disclosure.

The computing system 500 is configured to operate and/or control calibration of the elevator sensor system 220 of FIG. 2 using, for example, a flow process 600 of FIG. 6. The flow process 600 can be performed by a computing system 500 of the elevator sensor system 220 of FIG. 2 as shown and described herein and/or by variations thereon. Various aspects of the flow process 600 can be carried out using one or more sensors, one or more processors, and/or one or more machines and/or controllers. For example, some aspects of the flow process involve sensors, as described above, in communication with a processor or other control device and transmit detection information thereto. The flow process 600 is described in reference to FIGS. 1-6.

At block 602, a computing system 500 collects a plurality of data from one or more sensors 214 of an elevator sensor system 220 while a calibration device 222 applies a known excitation 324, for instance, to an elevator door 204. In some embodiments, one or more variations of the known excitation 324 are applied by the calibration device 222 at one or more predetermined locations 224 on the elevator door 204. The known excitation 324 can include a predetermined sequence of one or more vibration frequencies applied at one or more predetermined amplitudes. The data can be collected at two or more different landings 125 of elevator system 101, e.g., to perform floor-level specific calibration of the elevator sensor system 220.

At block 604, the computing system 500 compares an actual response 408 to an expected response 406 to the known excitation 324 using a trained model 404. The trained model 404 can be trained by applying a known excitation 304 to a different instance of the elevator sensor system 220 at experiment site 302 to produce the expected response 406, which can be reproduced at field sites 322.

At block 606, the computing system 500 performs analytics model calibration 410 to calibrate the trained model 404 based on one or more response changes between the actual response 408 and the expected response 406. Transfer learning can be applied to determine a transfer function 336 based on the one or more response changes across a range of data points produced by the known excitation 324.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method comprising:

collecting, by a computing system, a plurality of data from one or more sensors of an elevator sensor system while a calibration device applies a known excitation, wherein the known excitation comprises a predetermined sequence of one or more vibration frequencies applied at one or more predetermined amplitudes;

comparing, by the computing system, an actual response to an expected response to the known excitation using a trained model; and performing, by the computing system, analytics model calibration to calibrate the trained model based on one or more response changes between the actual response and the expected response.

2. The method of claim 1, wherein the trained model is trained by applying the known excitation to a different instance of the elevator sensor system to produce the expected response.

3. The method of claim 1, wherein performing analytics model calibration comprises applying transfer learning to determine a transfer function based on the one or more response changes across a range of data points produced by the known excitation.

4. The method of claim 3, wherein a baseline designation of the trained model is shifted according to the transfer function.

5. The method of claim 3, wherein transfer learning shifts at least one fault detection boundary of the trained model.

6. The method of claim 3, wherein transfer learning shifts at least one trained regression model.

7. The method of claim 6, wherein transfer learning shifts at least one trained fault detection model, and a fault designation comprises one or more of: a roller fault, a track fault, a sill fault, a door lock fault, a belt tension fault, a car door fault, and a hall door fault.

8. The method of claim 1, wherein one or more variations of the known excitation applied by the calibration device at one or more predetermined locations on an elevator system are collected.

9. The method of claim 1, wherein the data is collected at two or more different landings of an elevator system.

10. An elevator sensor system comprising:

one or more sensors operable to monitor an elevator system; and a computing system comprising a memory and a processor that collects a plurality of data from the one or more sensors while a calibration device applies a known excitation, compares an actual response to an expected response to the known excitation using a trained model, and performs analytics model calibration to calibrate the trained model based on one or more response changes between the actual response and the expected response, wherein the known excitation comprises a predetermined sequence of one or more vibration frequencies applied at one or more predetermined amplitudes.

11. The elevator sensor system of claim 10, wherein the trained model is trained by applying the known excitation to a different instance of the elevator sensor system to produce the expected response.

12. The elevator sensor system of claim 11, wherein performance of analytics model calibration comprises applying transfer learning to determine a transfer function based on the one or more response changes across a range of data points produced by the known excitation.

13. The elevator sensor system of claim 12, wherein a baseline designation of the trained model is shifted according to the transfer function.

14. The elevator sensor system of claim 12, wherein transfer learning shifts at least one fault detection boundary of the trained model.

15. The elevator sensor system of claim 12, wherein transfer learning shifts at least one trained regression model.

16. The elevator sensor system of claim 15, wherein transfer learning shifts at least one trained fault detection model, and a fault designation comprises one or more of: a roller fault, a track fault, a sill fault, a door lock fault, a belt tension fault, a car door fault, and a hall door fault.

17. The elevator sensor system of claim 10, wherein one or more variations of the known excitation applied by the calibration device at one or more predetermined locations on an elevator system are collected.

18. The elevator sensor system of claim 10, wherein the data is collected at two or more different landings.

* * * * *